US006913519B2

(12) United States Patent
Moore

(10) Patent No.: US 6,913,519 B2
(45) **Date of Patent: *Jul. 5, 2005**

(54) METHOD AND APPARATUS FOR MECHANICAL AND CHEMICAL-MECHANICAL PLANARIZATION OF MICROELECTRONIC SUBSTRATES

(75) Inventor: Scott E. Moore, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/683,972

(22) Filed: Oct. 10, 2003

(65) Prior Publication Data

US 2004/0097175 A1 May 20, 2004

Related U.S. Application Data

(63) Continuation of application No. 10/167,102, filed on Jun. 10, 2002, now Pat. No. 6,652,370, which is a continuation of application No. 09/924,066, filed on Aug. 7, 2001, now Pat. No. 6,419,572, which is a division of application No. 09/444,754, filed on Nov. 22, 1999, now Pat. No. 6,354,930, which is a continuation of application No. 09/001,333, filed on Dec. 30, 1997, now Pat. No. 6,139,402.

(51) Int. Cl.[7] ..... B24B 1/00
(52) U.S. Cl. ..... 451/41; 451/527; 451/530
(58) Field of Search ..... 451/41, 168, 173, 451/296, 526, 527, 530

(56) References Cited

U.S. PATENT DOCUMENTS

| | | | | |
|---|---|---|---|---|
| 5,209,760 | A | | 5/1993 | Wiand |
| 5,234,867 | A | | 8/1993 | Schultz et al. |
| 5,297,364 | A | | 3/1994 | Tuttle |
| 5,390,910 | A | | 2/1995 | Mandel et al. |
| 5,421,769 | A | | 6/1995 | Schultz et al. |
| 5,489,233 | A | | 2/1996 | Cook et al. |
| 5,554,064 | A | | 9/1996 | Breivogel et al. |
| 5,578,362 | A | | 11/1996 | Reinhardt et al. |
| 5,624,303 | A | | 4/1997 | Robinson |
| 5,628,862 | A | | 5/1997 | Yu et al. |
| 5,810,964 | A | | 9/1998 | Shiraishi |
| 5,839,947 | A | | 11/1998 | Kimura et al. |
| 6,022,268 | A | | 2/2000 | Roberts et al. |
| 6,054,183 | A | | 4/2000 | Zimmer et al. |
| 6,117,499 | A | | 9/2000 | Wong et al. |
| 6,139,402 | A | * | 10/2000 | Moore ..... 451/41 |
| 6,284,114 | B1 | | 9/2001 | Chechik et al. |
| 6,290,883 | B1 | | 9/2001 | Crevasse et al. |
| 6,328,632 | B1 | | 12/2001 | Chopra |
| 6,354,930 | B1 | | 3/2002 | Moore |
| 6,364,757 | B2 | | 4/2002 | Moore |
| 6,419,572 | B2 | * | 7/2002 | Moore ..... 451/530 |
| 6,514,130 | B2 | | 2/2003 | Moore |
| 6,537,190 | B2 | | 3/2003 | Moore |
| 6,652,370 | B2 | | 11/2003 | Moore |

FOREIGN PATENT DOCUMENTS

| | | |
|---|---|---|
| EP | 0685299 A1 | 12/1995 |
| WO | WO 94/04599 | 3/1994 |
| WO | WO 96/15887 | 5/1996 |
| WO | WO 97/47433 | 12/1997 |

* cited by examiner

*Primary Examiner*—Dung Van Nguyen
(74) *Attorney, Agent, or Firm*—Dorsey & Whitney LLP

(57) ABSTRACT

A method and apparatus for mechanically and/or chemical-mechanically planarizing microelectronic substrates. In one embodiment in accordance with the principles of the present invention, a microelectronic substrate is planarized or polished on a planarizing medium having a thin film and a plurality of micro-features on the film The film may be an incompressible sheet or web substantially impervious to a planarizing solution, and the micro-features may be configured in a selected pattern on the film to restrain fluid flow of the planarizing solution across the surface of the film under the substrate. The micro-features, for example, may be configured in a selected pattern that has a plurality of support points and at least one cavity to entrap a substantially contiguous, uniform distribution of the solution under the substrate during planarization. Additionally, the selected pattern of micro-features may be reproduced from a master pattern of micro-features to duplicate the selected pattern on several sections of film so that a consistent planarizing surface may be provided for a large number of substrates.

20 Claims, 6 Drawing Sheets

METHOD AND APPARATUS FOR MECHANICAL AND CHEMICAL-MECHANICAL PLANARIZATION OF MICROELECTRONIC SUBSTRATES

CROSS-REFERENCE TO RELATED APPLICATION

This application is a continuation of pending U.S. patent application Ser. No. 10/167,102, filed Jun. 10, 2002 now U.S. Pat. No. 6,652,370, which is a continuation of Ser. No. 09/924,066, filed Aug. 7, 2001, issued as U.S. Pat. No. 6,419,572 which is a divisional of U.S. patent application Ser. No. 09/444,754, filed Nov. 22, 1999, issued as U.S. Pat. No. 6,354,930, which is a continuation of U.S. patent application Ser. No. 09/001,333, filed Dec. 30, 1997, issued as U.S. Pat. No. 6,139,402.

TECHNICAL FIELD

The present invention relates to mechanical and chemical-mechanical planarization of microelectronic substrates. More particularly, an embodiment of the present invention relates to a planarization polishing pad for enhancing the performance and/or reducing the costs of planarizing substrates, and to methods of using and making the polishing pad.

BACKGROUND OF THE INVENTION

Mechanical and Chemical-Mechanical planarization processes remove material from the surface of semiconductor wafers, field emission displays and many other microelectronic substrates to form a flat surface at a desired elevation in the substrates. FIG. 1 schematically illustrates a planarizing machine 10 with a platen 20, a carrier assembly 30, a polishing pad 40, and a planarizing solution 44 on the polishing pad 40. The planarizing machine 10 may also have a compressible under-pad 25 attached to an upper surface 22 of the platen 20 for supporting the polishing pad 40. In many planarizing machines, a drive assembly 26 rotates (arrow A) and/or reciprocates (arrow B) the platen 20 to move the polishing pad 40 during planarization.

The carrier assembly 30 controls and protects a substrate 12 during planarization. The carrier assembly 30 generally has a lower surface 32 with a pad 34 that holds the substrate 12 via suction, and an actuator assembly 36 is typically attached to the carrier assembly 30 to rotate and/or translate the substrate 12 (arrows C and D, respectively). However, some carrier assemblies 30 are weighted, free-floating disks (not shown) that slide over the polishing pad 40.

The polishing pad 40 and the planarizing solution 44 may separately, or in combination, define a polishing environment that mechanically and/or chemically removes material from the surface of the substrate 12. The polishing pad 40 may be a conventional polishing pad made from a relatively compressible, porous continuous phase matrix material (e.g., polyurethane), or it may be an abrasive polishing pad with abrasive particles fixedly bonded to a suspension medium. The planarizing solution 44 may be a chemical-mechanical planarization slurry with abrasive particles and chemicals for use with a conventional non-abrasive polishing pad, or the planarizing solution 44 may be a liquid without abrasive particles for use with an abrasive polishing pad. To planarize the substrate 12 with the planarizing machine 10, the carrier assembly 30 presses the substrate 12 against a planarizing surface 42 of the polishing pad 40 in the presence of the planarizing solution 44. The platen 20 and/or the carrier assembly 30 then move relative to one another to translate the substrate 12 across the planarizing surface 42. As a result, the abrasive particles and/or the chemicals in the polishing environment remove material from the surface of the substrate 12.

Planarizing processes must consistently and accurately produce a uniformly planar surface on the substrate to enable precise fabrication of circuits and photo-patterns on the substrate. As the density of integrated circuits increases, the uniformity and planarity of the substrate surface is becoming increasingly important because it is difficult to form sub-micron features or photo-patterns to within a tolerance of approximately 0.1 $\mu$m when the substrate surface is not uniformly planar. Thus, planarizing processes must create a highly uniform, planar surface on the substrate.

In conventional planarizing processes, the substrate surface may not be uniformly planar because the rate at which material is removed from the substrate surface (the "polishing rate") typically varies from one region on the substrate to another. The polishing rate depends, in part upon the distribution of abrasive particles and chemicals between the substrate surface and the polishing pad. One particular problem with conventional planarizing devices and methods is that the perimeter of the substrate wipes a significant amount of the planarizing solution off of the polishing pad. As such, the planarizing solution builds up in a high zone along a leading edge of the substrate, which reduces the volume of planarizing solution contacting the center of the substrate. Conventional planarizing devices and methods, therefore, typically produce a non-uniform, center-to-edge planarizing profile across the substrate surface.

To reduce such a center-to-edge planarizing profile, several conventional non-abrasive polishing pads have holes or grooves on their upper surfaces to transport a portion of the planarizing solution below the substrate surface during planarization. A Rodel IC-1000 polishing pad, for example, is a relatively soft, porous polyurethane pad with a number of large slurry wells approximately 0.05–0.10 inches in diameter that are spaced apart from one another across the planarization surface by approximately 0.125–0.25 inches. The large wells are expected to hold small volumes of slurry below the planarizing surface so that the substrate may draw the slurry out of the wells as the substrate translates over the pad. However, such pads still produce a significant center-to-edge planarizing profile indicating that the perimeter of the substrate presses some of the slurry out of the wells ahead of the center of the substrate. U.S. Pat. No. 5,216,843 describes another polishing pad with a plurality of macro-grooves formed in concentric circles and a plurality of micro-grooves radially crossing the macro-grooves. Although such grooves may improve the planarity of the substrate surface, substrates planarized with such pads still exhibit non-uniformities across the substrate surface indicating an inadequate distribution of planarizing solution and abrasive particles across the substrate.

Other types of polishing pads also do not adequately resolve the center-to-edge planarizing profile. For example, conventional porous polishing pads with small micro-pores at the planarizing surface are generally subject to producing a center-to-edge planarizing profile indicating that the perimeter of the substrate presses the planarizing solution out of the pores before the center of the substrate passes over the pores. Additionally, even fixed-abrasive polishing pads that have a uniform distribution of abrasive particles may produce a center-to-edge planarizing profile because the perimeter of the substrate also tends to sweep the planarizing solution off of abrasive polishing pads. Therefore, conventional polishing pads typically produce an undesired center-to-edge planarizing profile on the substrate surface.

To improve the distribution of slurry under the substrate, U.S. Pat. No. 5,489,233 discloses a polishing pad composed of a solid, uniform polymer sheet having no intrinsic ability to absorb or transport slurry particles. One type of polymer sheet disclosed in U.S. Pat. No. 5,489,233 is Mylar® manufactured by E.I. du Pont de Nemours of Wilmington, Del. The Polymer sheet has a surface pattern or texture that has both large and small flow channels to permit the transport of slurry across the surface of the polishing pad. The channels are mechanically produced on the pad. In a preferred embodiment, the pad has a macro-texture produced prior to planarization and a micro-texture produced by abrading the pad with a plurality of small abrasive points at regular selected intervals during planarization. Although the pad disclosed in U.S. Pat. No. 5,489,233 improves the uniformity of the substrate surface in some circumstances, it may not provide consistent planarization characteristics because scratching the surface with small abrasive points may not duplicate the micro-texture from one pad to the next. Thus, the polishing pad described in U.S. Pat. No. 5,489,233 may not provide consistent results from one substrate to the next.

Another factor affecting the uniformity of the substrate surface is the condition of the polishing pad. The planarizing surface of the polishing pad typically deteriorates after polishing a number of substrates because waste matter from the substrate, planarizing solution and/or the polishing pad accumulates on the planarizing surface. The waste matter alters the local planarizing characteristics of the pad, and the waste matter typically does not accumulate uniformly across the planarizing surface. Thus, the waste matter accumulations cause the polishing rate to vary across the surface of the polishing pad.

Polishing pads are accordingly "conditioned" by removing the waste matter from the pad to restore the polishing pad to a suitable condition for planarizing substrates. However, even conditioning polishing pads may produce non-uniformities in the substrate surface because it is difficult to consistently condition a polishing pad so that it has the same planarizing characteristics from one conditioning cycle to the next. Conditioning the polishing pads, moreover, is time-consuming and requires costly equipment and labor. Therefore, in addition to the problems associated with providing an adequate distribution of planarizing solution between the substrate surface and the polishing pad, conditioning conventional polishing pads may also reduce the uniformity of the planarized substrate surface.

SUMMARY OF THE INVENTION

The present invention is a method and apparatus for mechanically and/or chemical-mechanically planarizing microelectronic substrates. In one embodiment in accordance with the principles of the present invention, a microelectronic substrate is planarized or polished on a planarizing medium having a thin film and a plurality of micro-features on the film. The film may be an incompressible sheet or web substantially impervious to a planarizing solution, and the micro-features may be configured in a selected pattern on the film to restrain fluid flow of the planarizing solution across the surface of the film under the substrate. The micro-features, for example, may be configured in a selected pattern with a plurality of substantially incompressible first raised features defining support points, at least one cavity below the support points, and a plurality of second raised features between and below the support points. The support points, cavity, and second raised features may operate to entrap a substantially contiguous, uniform distribution of the solution under the substrate during planarization. Additionally, the selected pattern of micro-features may be reproduced from a master pattern of micro-features to duplicate the selected pattern on the film so that a consistent planarizing surface may be provided for a large number of substrates.

The planarizing film may be composed of a number of different materials, and the micro-features may have a number of different configurations. For example, the film may be composed of a suitable polymeric material (e.g., Mylar® or Lexan®), or other flexible and substantially incompressible materials. The micro-features may be nodules with a plurality of shapes and heights formed from the film material or the nodules may be a fine mesh of woven fibers formed separately from the film. The nodules are generally patterned on the film to form a plurality of depressions that entrap the solution under the substrate, and a portion of the nodules preferably have flat tops terminating at a constant maximum height across the planarizing surface of the film to define the first raised features. The selected pattern of nodules and depressions may be produced by embossing the nodule pattern on the film, etching the depressions into the film, or other suitable techniques that may consistently reproduce the selected pattern of nodules on the planarizing film.

Planarizing mediums in accordance with the invention may be adapted to work with a variety of different planarizing machines. In one embodiment, for example, the film is a contiguous, flexible web with a plurality of sections that each have a planarizing surface with the selected pattern of micro-features. The flexible web may be indexed with respect to a work station or planarizing station of the planarizing medium so that all or only a part of a section is moved across the work station. When all of a section is advanced across the work station, a first section of the web may be held at the work station to planarize a first substrate and then a second section of the web may be held at the work station to planarize subsequent substrates. In another embodiment, the planarizing film may have a plurality of separate sheets in which each sheet has a planarizing surface, with one or more sections having the selected pattern of micro-features. As such, a first sheet is used to planarize a number of substrates until it deteriorates beyond an acceptable point, and then it may be replaced by a second sheet to planarize a number of additional substrates. In either the web or sheet films, the sections may be integral with one another or they may be separate segments attached to one another.

DETAILED DESCRIPTION OF THE INVENTION

The present invention is an apparatus and method for mechanical and/or chemical-mechanical planarization of substrates used in the manufacturing of microelectronic devices. Many specific details of certain embodiments of the invention are set forth in the following description and in FIGS. 2–6 to provide a thorough understanding of such embodiments. One skilled in the art, however, will understand that the present invention may have additional embodiments and may be practiced without several of the details described in the following description.

Figure 2:
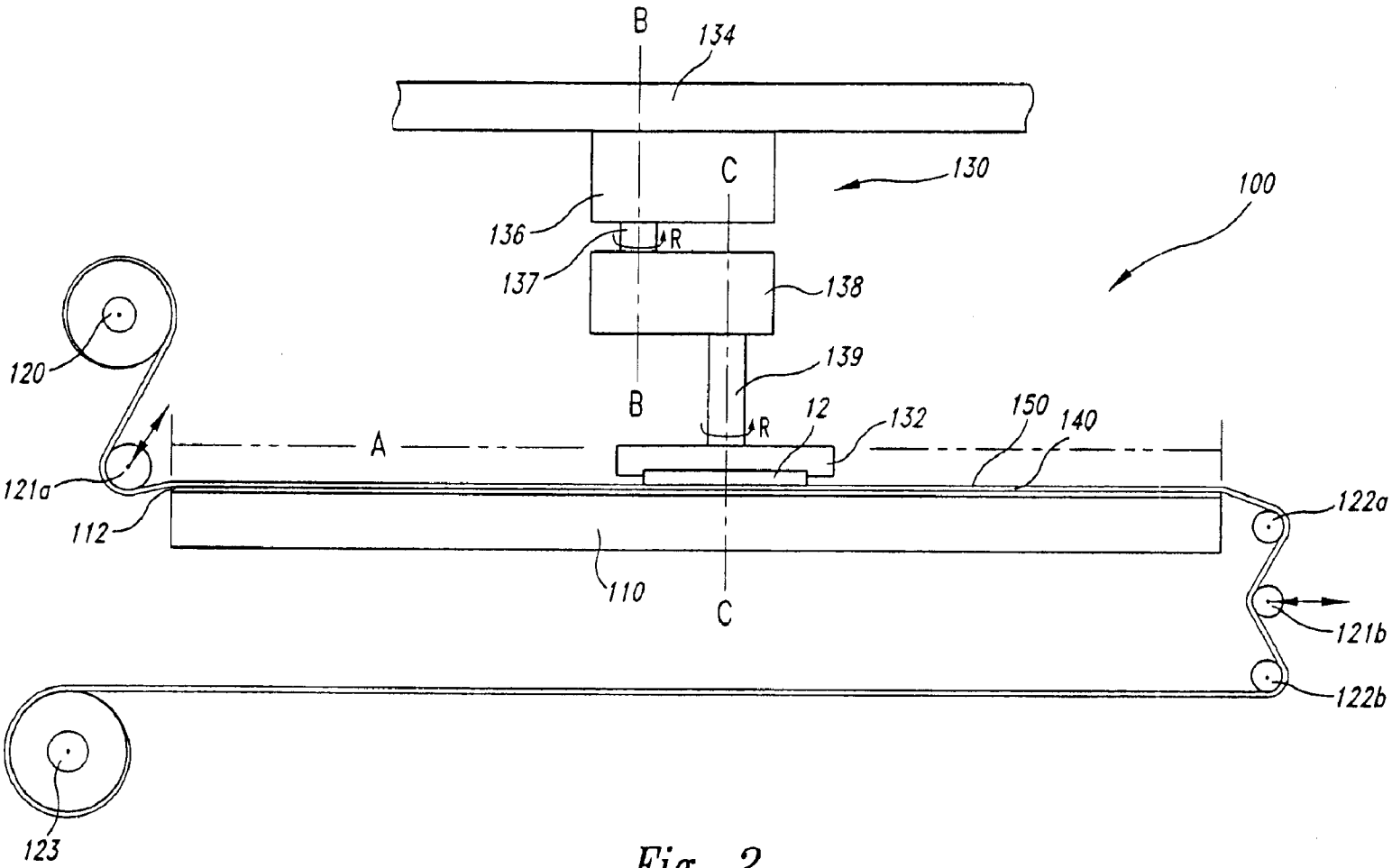
FIG. 2 is a schematic view of a planarizing machine with a planarizing medium in accordance with an embodiment of the invention.

FIG. 2 is a schematic view of an embodiment of a planarizing machine 100 and a planarizing medium 140 for planarizing a substrate 12. The features and advantages of the planarizing medium 140 are best understood in the context of the structure and operation of the planarizing machine 100. Thus, the general features of the planarizing machine 100 will be described initially.

The planarization machine 100 may have a support table 110 carrying a base 112 at a workstation or a planarization station where a section "A" of the planarizing medium 140 is positioned. The base 112 is generally a substantially incompressible support member attached to the table 110 to provide a flat, solid surface to which a particular section of the planarizing medium 140 may be secured during planarization. The planarizing machine 100 also has a plurality of rollers to guide, position and hold the planarizing medium 140 over the base 112. In one embodiment, the rollers include a supply roller 120, first and second idler rollers 121*a* and 121*b*, first and second guide rollers 122*a* and 122*b*, and a take-up roller 123. The supply roller 120 carries an unused part of the planarizing medium 140, and the take-up roller 123 carries a used part of the planarizing medium 140. The supply roller 120 and take-up roller 123 are driven rollers to sequentially advance unused portions of the planarizing medium 140 onto the base 112. As such, unused portions of the planarizing medium may be quickly substituted for worn used portions to provide a consistent surface for planarizing the substrate 12. Each portion of the planarizing medium 140 may correspond to an individual section "A" of the planarizing medium 140, but each portion may also be more or less than an individual section "A." The first idler roller 121*a* and the first guide roller 122*a* position the planarizing medium 140 slightly below the base 112 so that the supply and take-up rollers 120 and 123 stretch the planarizing medium 140 under tension to hold it stationary on the base 112 during planarization.

The planarization machine 100 also has a carrier assembly 130 to translate the substrate 12 across the planarizing medium 140. In one embodiment, the carrier assembly 130 has a substrate holder 132 to pick up, hold and release the substrate 12 at appropriate stages of the planarization process. The carrier assembly 130 may also have a support gantry 134 carrying an actuator 136 so that the actuator 136 can translate along the gantry 134. The actuator 136 preferably has a drive shaft 137 coupled to an arm assembly 138 that carries the substrate holder 132. In operation, the gantry 134 raises and lowers the substrate 12, and the actuator 136 orbits the substrate 12 about an axis B—B via the drive shaft 137. In another embodiment, the arm assembly 138 may also have an actuator (not shown) to drive a shaft 139 of the arm assembly 138 and thus rotate the substrate holder 132 about an axis C—C as the substrate holder 132 also orbits about the axis B—B. One suitable planarizing machine is manufactured by EDC Corporation. In light of the embodiment of the planarizing machine 100 described above, a specific embodiment of the planarizing medium 140 will now be described.

Figure 3:
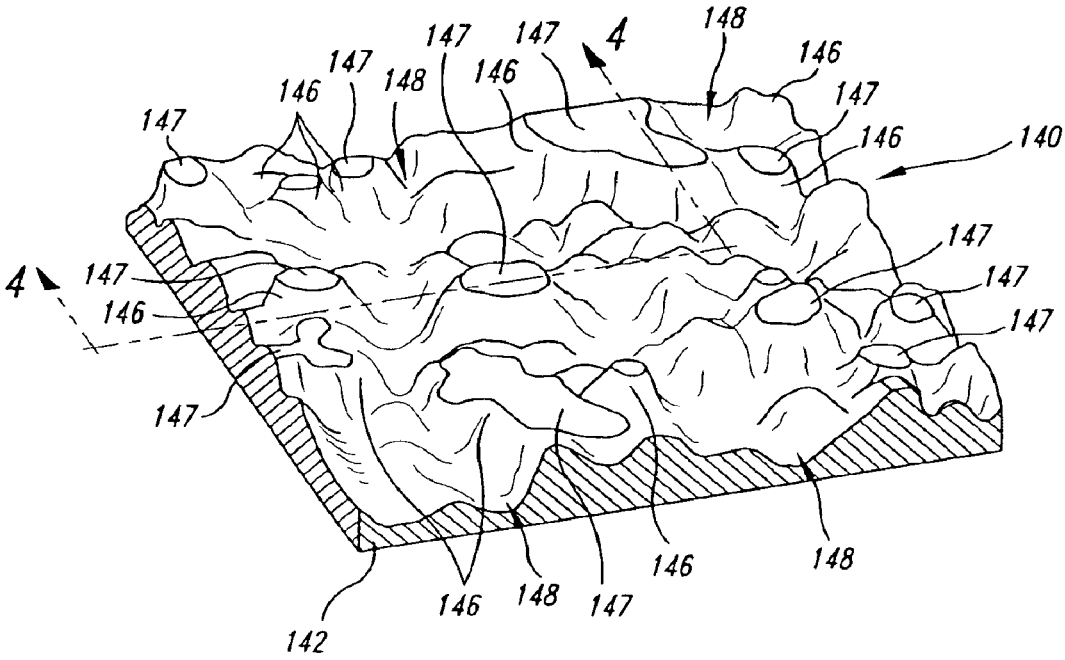
FIG. 3 is a partial isometric view of a planarizing medium with a planarizing film and a plurality of micro-features in accordance with one embodiment of the invention.
Figure 4:
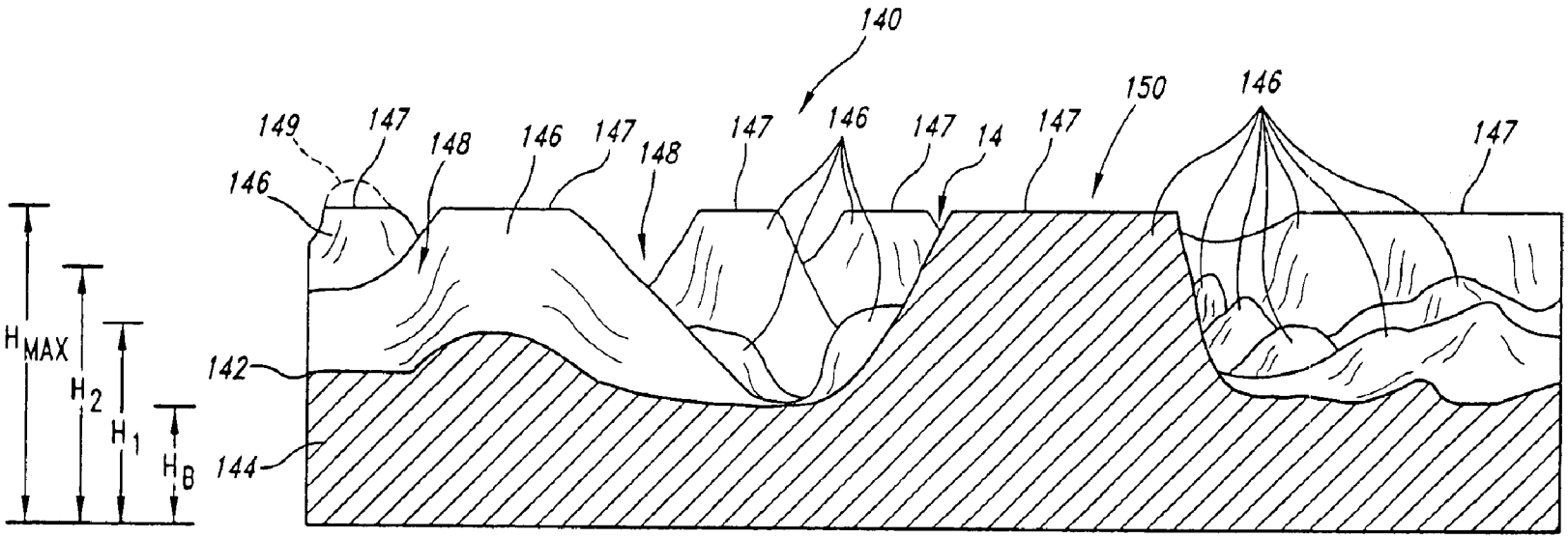
FIG. 4 is a partial schematic cross-sectional view of the planarizing medium shown in FIG. 3 along section 4—4.

FIG. 3 is a partial isometric view of an embodiment of the planarizing medium 140, and FIG. 4 is a partial schematic cross-sectional view of the planarizing medium 140 shown in FIG. 3 taken along section 4—4. The planarizing medium 140 has a planarizing film 142 and a plurality of micro-features 146 configured in a selected pattern on the film 142. The planarizing film 142 may be composed of a thin, inexpensive material that is impervious to the planarizing solution or generally impermeable to fluids. The planarizing film 142 is also preferably a flexible, yet substantially incompressible material that has a relatively high tensile strength. For example, the planarizing film may be a disposable material with a thickness between approximately 0.0005 inches and 0.050 inches. In some particular embodiments of the planarizing medium 140, the planarizing film 142 may be a mono-layer web or sheet composed of polymeric or other suitable materials. For example, two specific polymers suitable for the planarizing film 142 are polyester (e.g., Mylar manufactured by E.I. du Pont de Nemours Co.) and polycarbonate (e.g., Lexan manufactured by General Electric Co.). Other suitable polymers include polyurethane and nylon.

The micro-features 146 may be configured in a selected pattern on the film 142 to restrain fluid flow or otherwise entrap small micro-volumes of the planarizing solution (not shown) under a substrate surface (not shown) across the film 142. The selected pattern of micro-features 146 may be reproduced from a master pattern that consistently duplicates the selected pattern across all or a portion of the planarizing medium 140. In one embodiment, for example, the selected pattern is duplicated on portions of the planarizing medium 140 corresponding to the size of the section "A" at the planarization station of the planarizing machine 100 (FIG. 2). Accordingly, the planarizing characteristics of the planarizing medium 140 are consistent from one section to the next to enhance the accuracy of the planarizing process. The selected pattern of micro-features 146 may be a substantially random distribution of features across the planarizing film 142, or the micro-features may be formed in a substantially symmetrical, uniform pattern. The micro-features 146 may also be formed integrally with the film 142, or the micro-features may be composed of a separate material attached to a flat sheet of film.

As shown in FIGS. 3 and 4, the micro-features 146 may be nodules with different shapes and heights that form depressions 148 in the film 142 between the nodules 146. As best shown in FIG. 4, the planarizing film 142 has a contiguous portion 144 up to a height $H_B$, and the nodules 146 extend upwardly from the height $H_B$ to a plurality of different heights. For example, a few of the nodules 146 may extend to a plurality of intermediate heights $H_1$ and $H_2$, while other nodules are flat-top nodules 147 terminating at a substantially constant height $H_{max}$ defining a planarizing surface 150 (FIG. 4 only) of the planarizing medium 140. The flat-top nodules 147 may define first raised features that act as support points on the planarizing surface 150 to engage or otherwise support the substrate 12, and the remaining nodules 146 with intermediate heights may define second raised features. Additionally, the depressions 148 may form at least one cavity below the flat-top nodules 147.

In another embodiment, even the highest nodules may have rounded peaks 149 (shown in phantom in FIG. 4) instead of the flat-top nodules 147. The nodules 146 preferably have heights of 0.5 $\mu$m to 100 $\mu$m with respect to the height $H_B$, and they are approximately 50 $\mu$m to 500 $\mu$m across at their base.

The selected pattern of micro-features 146 and depressions 148 illustrated in FIGS. 3 and 4 represents only one embodiment of a planarizing medium 140 suitable for planarizing microelectronic substrates. As such, virtually any pattern of micro-features that provides an adequate distribution of planarizing solution and abrasive particles underneath a substrate during planarizing may be used. Additionally, the nodules 146 may have other sizes and heights outside of the ranges set forth above.

The micro-features 146 may be formed on the planarizing film 142 by a number of methods. For example, when the planarizing film 142 is composed of a polymeric material, the selected pattern of micro-features 146 may be duplicated on the planarizing medium 140 by embossing the selected pattern of micro-features onto the planarizing film 142 with a die or stamp having the inverse of the selected pattern of micro-features. The die may be pressed against the planarizing film at a temperature sufficient to allow the film to permanently conform to the topography of the die. In the embodiment of the planarizing medium 140 illustrated in FIGS. 3 and 4, the micro-features 146 are formed by embossing a 0.010 to 0.020 inch thick film of Lexan with a die having a pattern of rounded nodules, and then planarizing a sacrifice wafer on the rounded nodules to form the flat-top nodules 147 at the maximum height $H_{max}$. In another embodiment, the selected pattern may be photo-patterned and then etched into the planarizing film. Thus, unlike micro-features that are scratched or abraded into a thin sheet, the selected pattern may be accurately duplicated across all or part of the planarizing medium to provide consistent planarization characteristics from one substrate to the next.

Figure 1:
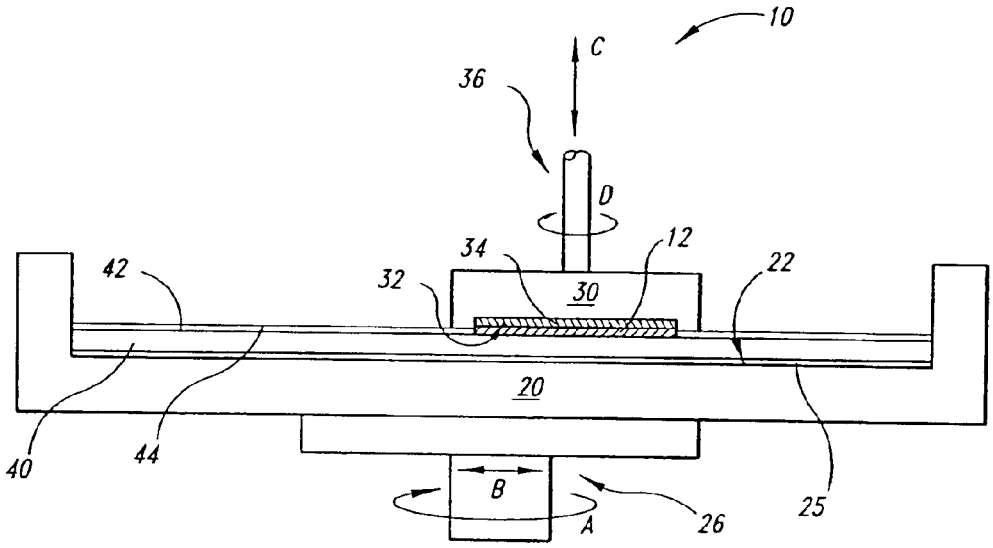
Fig. 1 (Prior Art)
FIG. 1 is a schematic view of a planarizing machine in accordance with the prior art.
Figure 5:
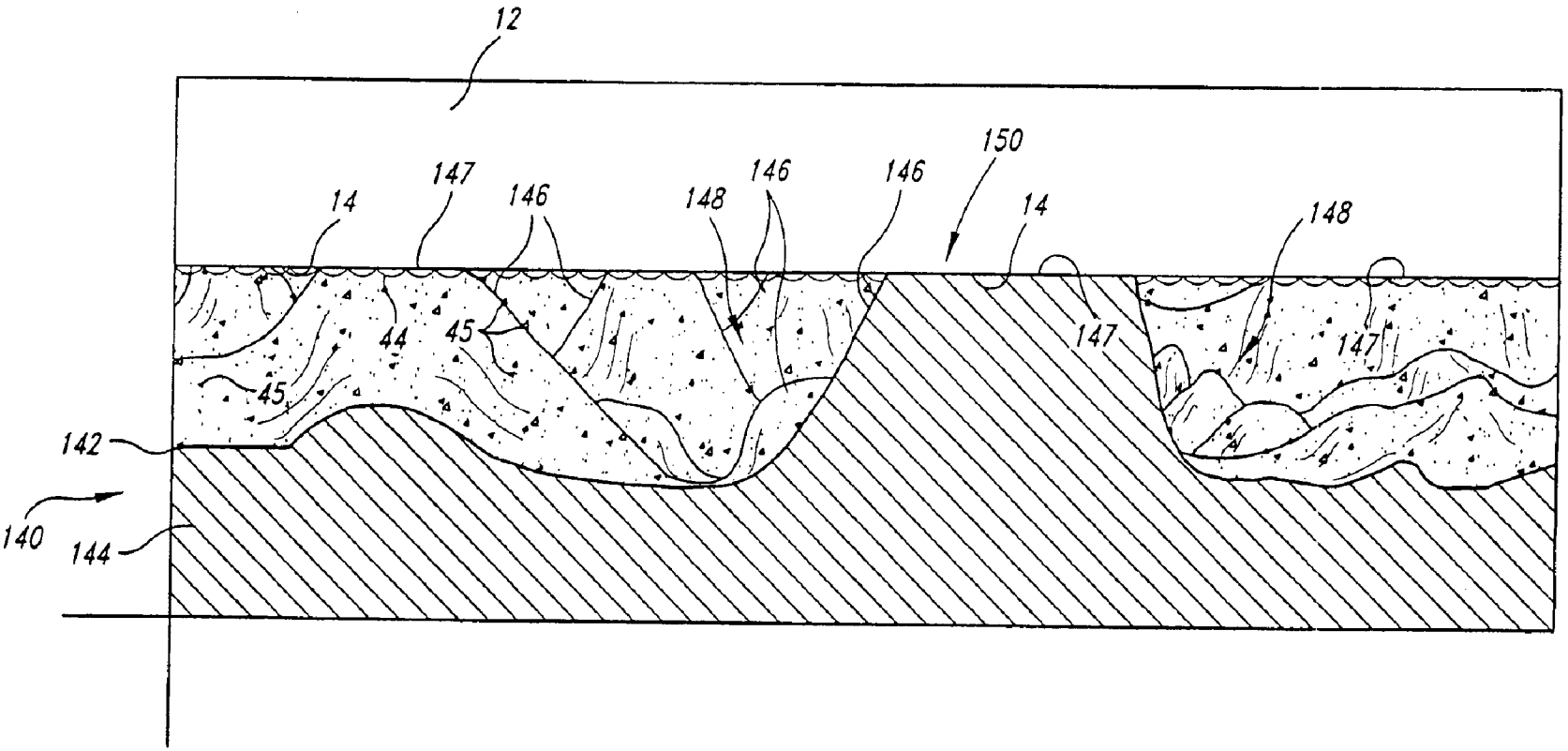
FIG. 5 is a partial schematic cross-sectional view of the planarizing medium of FIG. 4 shown planarizing a substrate using a planarizing solution with abrasive particles in accordance with an embodiment of the invention.

FIG. 5 is a schematic cross-sectional view that illustrates the operation and some advantages of the planarizing medium 140. In operation, a supply line (not shown) deposits planarizing solution 44 onto the planarizing medium 140 as the carrier assembly 30 (FIG. 1) translates the substrate 12 over the flat-top nodules 147. A small volume of the planarizing solution 44 accumulates in the depressions 148 between the nodules 146. Additionally, when the planarizing solution contains abrasive particles 45, a portion of the abrasive particles 45 may also accumulate in the depressions 148. The depressions 148 accordingly provide at least one large cavity under the flat-top nodules 147 to preferably hold a substantially uniform, contiguous distribution of planarizing solution 44 and abrasive particles 45 under a surface 14 of the wafer 12. The nodules 146 restrain the flow or otherwise entrap the planarizing solution 44 and the abrasive particles 45 to inhibit the perimeter of the substrate 12 from sweeping the solution 44 and the particles 45 off of the medium 140. Additionally, when nodules 146 are substantially incompressible, the flat-topped nodules 147 prevent the substrate 12 from penetrating into the depressions 148 and forcing the planarizing solution 44 and the abrasive particles 45 out of the depressions 148.

Compared to conventional polishing pads, the planarizing medium 140 is expected to produce highly uniform, planar surfaces on semiconductor wafers and other microelectronic substrates. The planarizing medium 140 is believed to improve the planarizing performance because the micro-features 146 restrain the fluid flow or otherwise entrap a substantially uniform, contiguous distribution of planarizing solution 44 and abrasive particles 45 in the depressions 148 underneath the surface 14 of the substrate 12. Additionally, the film 142 may be a highly planar, substantially incompressible sheet or web that does not conform to the topography of the substrate surface 14. The planarizing medium 140 accordingly imparts high mechanical energy to high points on the substrate surface 14, while inhibiting the substrate 12 from sweeping the planarizing solution 44 and abrasive particles 45 off of the planarizing medium 140.

In addition to the advantages described above, the planarizing medium 140 illustrated in FIGS. 3–5 may also provide a very consistent, inexpensive surface for planarizing substrates. Unlike conventional polishing pads composed of polyurethane or containing fixed abrasive particles, the planarizing medium 140 may be composed of an inexpensive, disposable film 142 that may be economically thrown away after the planarizing surface 150 is no longer in a state suitable for planarizing substrates. As a result, expensive conditioning equipment and skilled labor are not necessary to provide a clean planarizing surface. Additionally, because the selected pattern of micro-features may be duplicated across the planarizing medium 140, consistent planarizing characteristics may be maintained over a larger number of substrates. Therefore, the planarizing medium 140 may not only eliminate the need to constantly condition the planarizing surface, it may also enhance the consistency of the planarizing characteristics over a large number of substrates.

Figure 6:
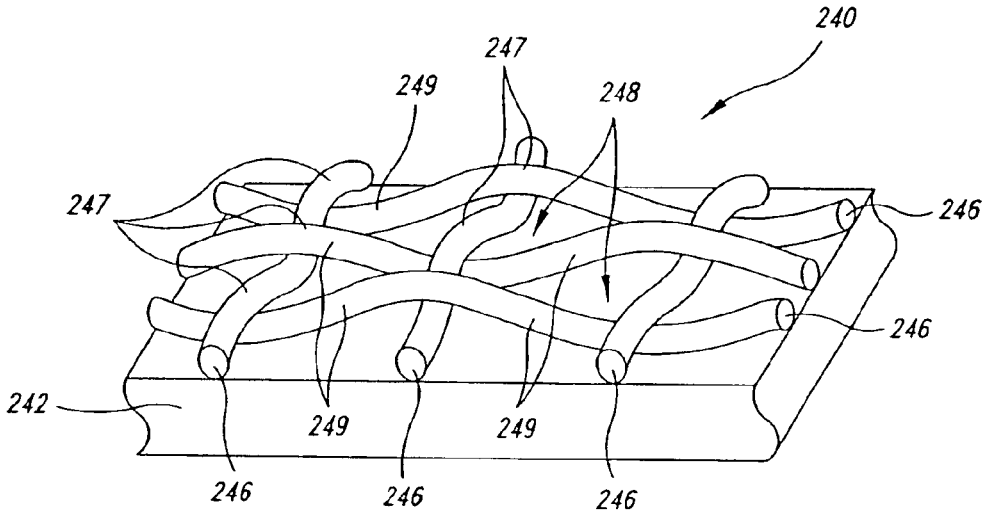
FIG. 6 is a partial schematic isometric view of another planarizing medium in accordance with another embodiment of the invention.

FIG. 6 is a partial schematic isometric view illustrating another embodiment of a planarizing medium 240 in accordance with the invention with a planarizing film 242 and a plurality of micro-features 246 formed separately from the planarizing film 242. The planarizing film 242 may be similar to the film 142 discussed above with respect to FIGS. 3–5. The micro-features 246, however, may be a fine woven mesh of strands attached to the film 242. For example, the micro-features 246 may be a woven mesh of 2.0 $\mu$m to 5.0 $\mu$m diameter nylon strands spaced apart by openings 248 that define approximately 0.5% to 5% of the surface area of the mesh. The woven mesh accordingly has a plurality of first raised features defined by high points 247 along the strands, a plurality of second raised features 249 defined by the remainder of the strands above the film 242, and at least one cavity below the high points 247 of the strands defined by the openings 248. The micro-features 246 and openings 248 of the planarizing medium 240 may thus capture and contain a planarizing solution (not shown) beneath the high points 247 of the micro-features 246 to provide a substantially uniform distribution of planarizing solution and abrasive particles underneath the substrate (not shown) during planarization. The embodiment of the planarizing medium 240 illustrated in FIG. 6, therefore, may achieve many of the same advantages described above with respect to the embodiment of the planarizing medium 140 illustrated in FIGS. 3–5.

From the foregoing it will be appreciated that, although specific embodiments of the invention have been described herein for purposes of illustration, various modifications may be made without deviating from the spirit and scope of the invention. For example, other patterns of micro-features may be used, and the woven mesh shown in FIG. 6 may be composed of strands made from other materials. Additionally, planarizing media in accordance with the invention are not necessarily limited or required to achieve substantially the same results as the embodiments of planarizing media 140 and 240 described above. The invention, therefore, is not limited except as by the appended claims.

What is claimed is:

1. A method of manufacturing a microelectronic substrate, comprising:

positioning a non-abrasive and incompressible planarizing film on a support base of a planarizing machine, the planarizing film having a plurality of microfeatures having a plurality of first raised features having first peaks at a first height defining support points to contact the substrate and a plurality of second raised features having second peaks at heights less than the first height, the second raised features being interspersed between the first raised features; and engaging the substrate with the plurality of microfeatures to planarize a surface of the substrate.

2. The method of claim 1, wherein engaging the substrate with the plurality of microfeatures further comprises moving at least one of the substrate and the planarizing film with respect to the other to translate the substrate across the planarizing film.

3. The method of claim 1, further comprising disposing a planarizing solution on a surface of the planarizing film; and wherein engaging the substrate with the plurality of microfeatures further comprises entrapping at least a portion of the planarizing solution between the plurality of first raised features and the plurality second raised features.

4. The method of claim 3, wherein entrapping at least a portion of the planarizing solution between the plurality of first raised features and the plurality second raised features further comprises restraining a flow of the planarizing flow on the planarizing film; and retaining a substantially uniform and contiguous distribution of the planarizing fluid between the plurality of first raised features and the plurality second raised features.

5. The method of claim 1, wherein positioning a non-abrasive and incompressible planarizing film on a support base of a planarizing machine further comprises disposing a polymeric planarizing film on the support base that has a plurality of microfeatures that are embossed on the film in a substantially repetitive arrangement.

6. The method of claim 1, wherein positioning a non-abrasive and incompressible planarizing film on a support base of a planarizing machine further comprises disposing a polymeric planarizing film on the support base that has a plurality of microfeatures that are embossed on the film in a substantially random arrangement.

7. The method of claim 1, wherein positioning a non-abrasive and incompressible planarizing film on a support base of a planarizing machine further comprises disposing a fine woven mesh on the support base having a plurality of first raised features defined by high points along the strands, and having a plurality of second raised features defined by a remainder of the strands.

8. The method of claim 1, wherein positioning a non-abrasive and incompressible planarizing film on a support base further comprises:

wrapping a flexible web having the plurality of microfeatures around a supply roller and a take up roller; and extending a portion of the flexible web across the support base.

9. The method of claim 8, further comprising retaining a first portion of the web at a work station while a first substrate is planarized; and advancing the web to position a second portion of the web at the work station to planarize a second substrate.

10. The method of claim 1, wherein positioning a non-abrasive and incompressible planarizing film on a support base further comprises removably attaching the planarizing film to the support base.

11. A method of manufacturing a microelectronic substrate, comprising:

positioning a non-abrasive and incompressible planarizing film on a support base of a planarizing machine, the planarizing film having a plurality of nodules having a plurality of shapes and heights, the nodules being patterned on the film to form a plurality elevated support points to contact the substrate and a plurality of depressions between the elevated support points; and engaging the substrate with the plurality of nodules to planarize a surface of the substrate.

12. The method of claim 11, wherein engaging the substrate with the plurality of nodules further comprises moving at least one of the substrate and the planarizing film with respect to the other to translate the substrate across the planarizing film.

13. The method of claim 11, further comprising disposing a planarizing solution on a surface of the planarizing film; and wherein engaging the substrate with the plurality of nodules further comprises entrapping at least a portion of the planarizing solution between the plurality of nodules.

14. The method of claim 13, wherein entrapping at least a portion of the planarizing solution between the plurality of nodules comprises restraining a flow of the planarizing flow on the planarizing film; and retaining a substantially uniform and contiguous distribution of the planarizing fluid between the plurality of nodules.

15. The method of claim 11, wherein positioning a non-abrasive and incompressible planarizing film on a support base of a planarizing machine further comprises disposing a polymeric planarizing film on the support base that has a plurality of nodules that are embossed on the film in a substantially repetitive arrangement.

16. The method of claim 11, wherein positioning a non-abrasive and incompressible planarizing film on a support base of a planarizing machine further comprises disposing a polymeric planarizing film on the support base that has a plurality of nodules that are embossed on the film in a substantially random arrangement.

17. The method of claim 11, wherein positioning a non-abrasive and incompressible planarizing film on a support base of a planarizing machine further comprises disposing a fine woven mesh on the support base having a plurality of first raised features defined by high points along the strands, and having a plurality of second raised features defined by a remainder of the strands.

18. The method of claim 11, wherein positioning a non-abrasive and incompressible planarizing film on a support base further comprises:

wrapping a flexible web having the plurality of nodules around a supply roller and a take up roller; and extending a portion of the flexible web across the support base.

19. The method of claim 18, further comprising retaining a first portion of the web at a work station while a first substrate is planarized; and advancing the web to position a second portion of the web at the work station to planarize a second substrate.

20. The method of claim 11, wherein positioning a non-abrasive and incompressible planarizing film on a support base further comprises removably attaching the planarizing film to the support base.

* * * * *